US006665884B1

(12) United States Patent
Demps et al.

(10) Patent No.: US 6,665,884 B1
(45) Date of Patent: Dec. 23, 2003

(54) HELMET WITH SELF-ADJUSTING PADDING

(75) Inventors: Justin R. Demps, Cookeville, TN (US); Robert Brian Howard, Cookeville, TN (US); J. L. Cherry, Gainsboro, TN (US)

(73) Assignee: Adams USA, Cookeville, TN (US)

( * ) Notice: Subject to any disclaimer, the term of this patent is extended or adjusted under 35 U.S.C. 154(b) by 0 days.

(21) Appl. No.: 10/177,258

(22) Filed: Jun. 21, 2002

Related U.S. Application Data

(60) Provisional application No. 60/385,258, filed on May 31, 2002.

(51) Int. Cl.[7] ..... A42B 3/00; A42B 1/22; A63B 71/10

(52) U.S. Cl. ..... 2/414; 2/418; 2/425

(58) Field of Search ..... 2/414, 417, 418, 2/419, 420, 425, 421, 183, DIG. 11, 918, 411, 412, 413

(56) References Cited

U.S. PATENT DOCUMENTS

| | | | | | |
|---|---|---|---|---|---|
| 532,567 | A | * | 1/1895 | Larwood, Jr. | 2/421 |
| 2,706,294 | A | * | 4/1955 | Sprinkle | 2/414 |
| 2,969,547 | A | | 1/1961 | Dye | |
| 2,983,923 | A | * | 5/1961 | Aileo | 2/418 |
| 3,153,792 | A | | 10/1964 | Marietta | |
| 3,241,154 | A | * | 3/1966 | Aileo | 2/419 |
| 3,329,968 | A | * | 7/1967 | Gordon | 2/418 |
| 3,486,169 | A | * | 12/1969 | Rawlings | 2/414 |
| 3,787,894 | A | * | 1/1974 | Goodman, Jr. | 2/418 |
| 3,991,423 | A | * | 11/1976 | Jones | 2/415 |
| 4,843,642 | A | | 7/1989 | Brower | 2/6 |
| 5,337,420 | A | * | 8/1994 | Haysom et al. | 2/410 |
| 5,511,250 | A | * | 4/1996 | Field et al. | 2/418 |
| 5,575,017 | A | | 11/1996 | Hefling et al. | 2/418 |
| 5,694,649 | A | | 12/1997 | Hefling et al. | 2/418 |
| 5,815,847 | A | | 10/1998 | Holden, Jr. | 2/418 |
| 5,930,840 | A | | 8/1999 | Arai | 2/411 |
| 6,085,357 | A | | 7/2000 | Broersma | 2/416 |
| 6,128,786 | A | | 10/2000 | Maddux et al. | 2/418 |
| 6,240,571 | B1 | | 6/2001 | Infusino | 2/414 |

* cited by examiner

*Primary Examiner*—Rodney M. Lindsey
(74) *Attorney, Agent, or Firm*—Waddey & Patterson; Mark J. Patterson; Phillip E. Walker

(57) ABSTRACT

The present invention provides a helmet with self-adjusting padding designed to adjust to various head sizes of individual wearers of the helmet. The protective helmet comprises a helmet shell having a interior surface, a first helmet pad, a second helmet pad, and at least one expandable band. Each of the first and second helmet pads comprise a first pad section attached to the interior surface of the helmet and a second pad section spaced away from the interior surface of the helmet. At least one expandable band is attached to each of the second pad sections.

10 Claims, 3 Drawing Sheets

HELMET WITH SELF-ADJUSTING PADDING

This application claims benefit of co-pending U.S. patent application Ser. No. 60/385,258, filed May 31, 2002, entitled "Batting Helmet With Self-Adjusting Interior Foam Cushioning" which is hereby incorporated by reference. Be it known that we, Justin R. Demps, a citizen of the United States, residing at 7310 Long Lane Road, Cookeville, Tenn. 38506, Robert Brian Howard, a citizen of the United States, residing at 1220 Pimilco Drive, Cookeville, Tenn. 38506, and J. L. Cherry, a citizen of the United States, residing at 1875 Trace Creek Rd. Gainesboro, Tenn. 38562, have invented a new and useful "Helmet with Self-Adjusting Padding."

BACKGROUND OF THE INVENTION

The present invention relates generally to self-adjusting padding that fits within a helmet and conforms to the head of a wearer of the helmet.

DESCRIPTION OF PRIOR ART

Protective padded wear has many uses and is present in various industries. The protective head wear is generally described as a helmet and is used to protect the head of the wearer of the helmet from injury. The helmets are used in numerous areas including construction, military, and sports. The sizes of the protective helmets used must vary according to the variance in size of the human head. This creates a greater expense for organizations that have numerous persons requiring the protective helmet.

Others have attempted to provide different forms of adjustable helmets. For example, Broersma U.S. Pat. No. 6,085,357 uses both suspension and retention straps to provide adjustment for the head gear fitting and accessory system disclosed in the patent. The suspension and retention straps are designed to adjust the helmet in a vertical direction to allow for a variance in head size when that variance is measured from the crown of the head to the chin. However, the straps in the Broersma patent fail to adjust to a variance in the circumference of head sizes of wearers of the Broersma helmet. The Broersma patent also uses stays located within the head gear system to allow movement of the padding within the head gear. However, the use of these stays to alter the position of the padding within the head gear can cause misplacement of the padding within the head gear and reduce the effectiveness of the head gear.

Other attempts have been made to create adjustable protective head gear. For example, U.S. Pat. No. 5,375,420 issued to Haysom et al discloses a protective helmet with a removable band. The band is placed around the head and then a helmet is placed on top of the head around the band. The fact that the protective helmet is not a single assembly results in misplacement of the individual sections of Haysom et al. head gear as well as increasing the cost of the head gear.

U.S. Pat. No. 5,815,847 issued to Holden Jr., discloses a baseball batters helmet that provides adjustable padding within the helmet. The padding requires manual adjusting straps in order to conform the padding to the different head sizes of various users of the Holden Jr. helmet. Also, the protective shell in the Holder Jr. helmet has openings where the straps must extend through the protective shell to the external portion of the helmet. This weakens the structural integrity of the Holden Jr. helmet and requires manual manipulation in order to adjust the helmet to different head sizes.

Also, U.S. Pat. No. 6,240,571B1 issued to Infusino discloses a protective helmet with an adjustable helmet liner. The Infusino device has an expandable band mechanically fixed to the shell of a helmet, an adjustable helmet liner mechanically fixed to the expandable band and absorption padding attached to the helmet liner. The Infusion patent fails to adequately disclose an adjustable helmet due to the mechanical attachment of the expandable band to the helmet shell. This mechanical attachment restricts the band from properly adjusting to the head of wearer of the Infusino helmet thereby lessening the adjustable characteristic of the Infusino helmet.

Due to the lack of adequate adjustable helmets used for cranial protection, there is a need in the art for a helmet with a self-adjusting interior padding.

SUMMARY OF THE INVENTION

The present invention provides a helmet with self-adjusting padding designed to adjust to various head sizes of individual wearers of the helmet. The protective helmet comprises a helmet shell having a interior surface, a first helmet pad, a second helmet pad, and at least one expandable band. Each of the first and second helmet pads comprise a first pad section attached to the interior surface of the helmet and a second pad section spaced away from the interior surface of the helmet. At least one expandable band is attached to each of the second pad sections.

The protective helmet also comprises a pad gap separating the first and second helmet pads. The expandable band extends across the pad gap and allows adjustment of the band and of the first and second helmet pads in order to conform to the head of a user of the protective helmet. The band and the helmet pads are spaced away from the interior surface of the helmet shell in order to allow the band and the helmet pads to move toward the helmet interior surface once a user of the protective helmet has inserted his or her head into the protective helmet.

It is therefore a general object of the present invention to provide adjustable padding for a helmet.

Another object of the present invention is to provide self-adjusting padding for a helmet.

Still yet another object of the present invention is provide a helmet containing self-adjusting padding that conforms to the head of a wearer of the helmet.

Still yet another object of the present invention is to provide a helmet with self-adjusting padding that provides a location for pony-tail styled hair to extend out of the helmet.

Still yet another object of the present invention is to provide an adjustable helmet without weakening the structural integrity of the helmet.

Numerous other objects, features and advantages of the present invention will be readily apparent to those skilled in the art, upon a reading of the following disclosure, when taken in conjunction with the accompanying drawings.

BRIEF DESCRIPTION OF THE DRAWINGS

FIG. 2 shows the spatial relationship between the padding sections of the current invention.

FIG. 3 shows the adjustable nature of the self-adjusting padding.

DESCRIPTION OF THE PREFERRED EMBODIMENTS

Figure 1:
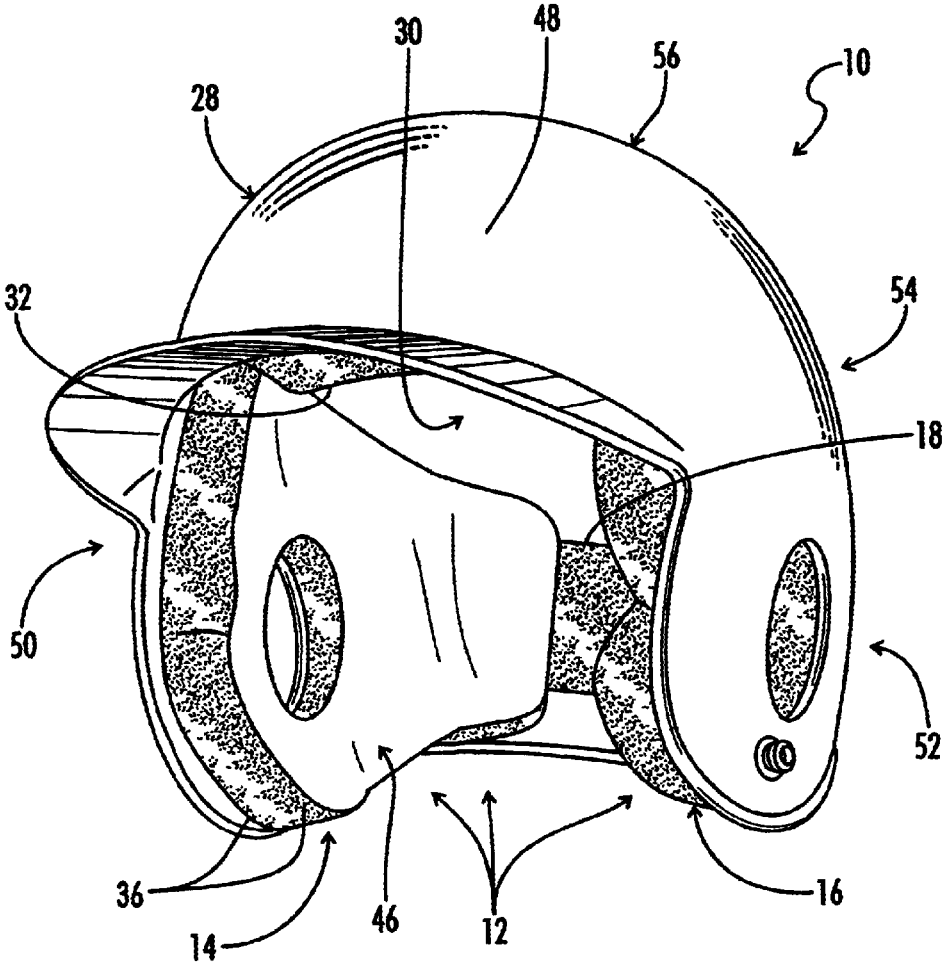
FIG. 1 is a perspective view of the invention comprising the self-adjustable padding.

Referring now to FIG. 1, the protective helmet containing the self-adjusting padding of the present invention is shown and generally designated by the numeral 10. The protective helmet 10 includes a helmet shell 28 and self-adjusting padding 12. The helmet shell 28 includes an interior surface 30. The self-adjusting padding 12 includes a first helmet pad 14 partially attached to the interior surface 30 of the helmet 10, a second helmet pad 16 partially attached to the interior surface 30 of the helmet 10, and at least one expandable band 18 partially attached to the first and second helmet pads 14 and 16 and designed to adjust the first and second helmet pads 14 and 16.

Figure 2:
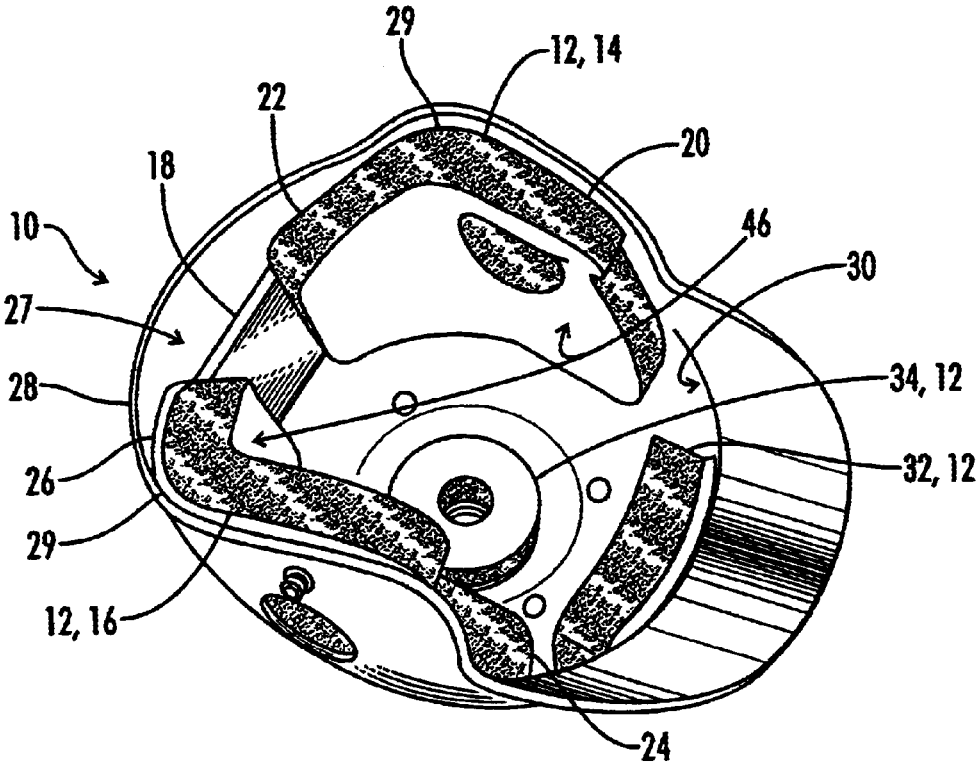
FIG. 2 is a perspective view of the internal portions of the helmet.
Figure 4:
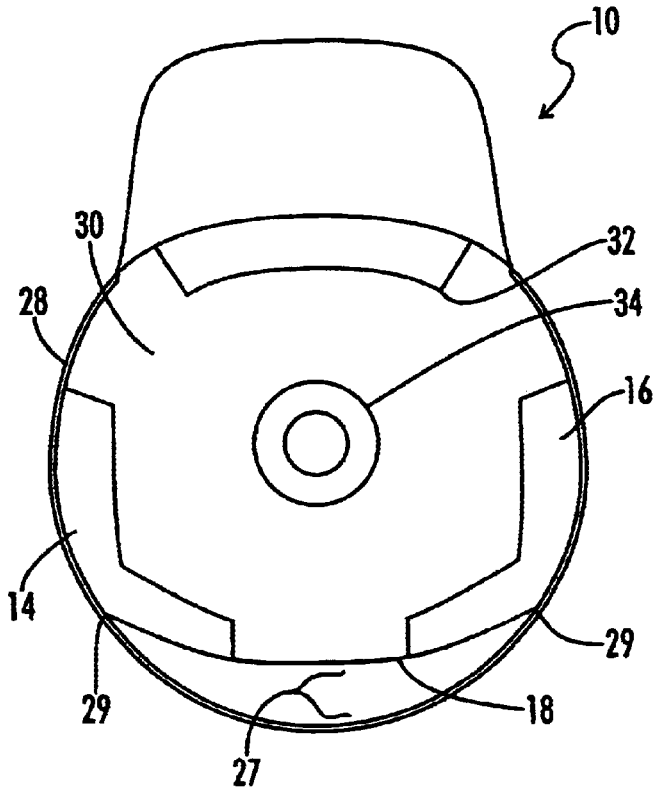
FIG. 4 is a bottom view of one embodiment of the current invention showing the first helmet pad, second helmet pad, at least one expandable band, and the spacing between these features and the interior surface of the helmet.

As seen in FIG. 2, the first helmet pad 14 includes a first pad section 20, also called an attachment section 20, attached to the helmet and a second pad section 22, also called a hinged section 22, attached to the expandable band 18. The second helmet pad 16 includes a first pad section 24, also called an attachment section 24, attached to the helmet 10 and a second pad section 26, also called a hinged section 26, attached to the expandable band 18. The expandable band 18 and second pad sections 22 and 26 are spaced away from the interior surface 30 so as to create spatial gap 27 between the interior surface 30 and the expandable band 18 and second pad sections 22 and 26. This is best seen in FIG. 4.

Both the self-adjusting padding 12 and the protective helmet shell 28 are designed to deflect and absorb the energy of an object that impacts with the helmet 10 before said energy reaches the head of a wearer of the helmet 10. This absorption is assisted by the attachment of the first and second pads sections 20 and 22 to the interior surface 30 of the helmet shell 28. In a preferred embodiment this attachment is by the way of adhesion, but can be by any technique known by those skilled in the art, including to, but not limited to, adhesives, mechanical fixtures, hook and loop fasteners, and the like.

The protective helmet shell 12 can be comprised of any substances known in the art to be lightweight yet resilient to impact. In a preferred embodiment, the helmet shell 12 is made of plastic.

The expandable band 18, also known as an elastic band 18 or an adjustable band 18, spaces the hinged sections 22 and 26 of the first and second helmet pads 14 and 16 away from the helmet 10. More specifically, the adjustable band 18 spaces the hinged sections 22 and 26 away from the interior surface 30 of the protective helmet shell 28.

Figure 3:
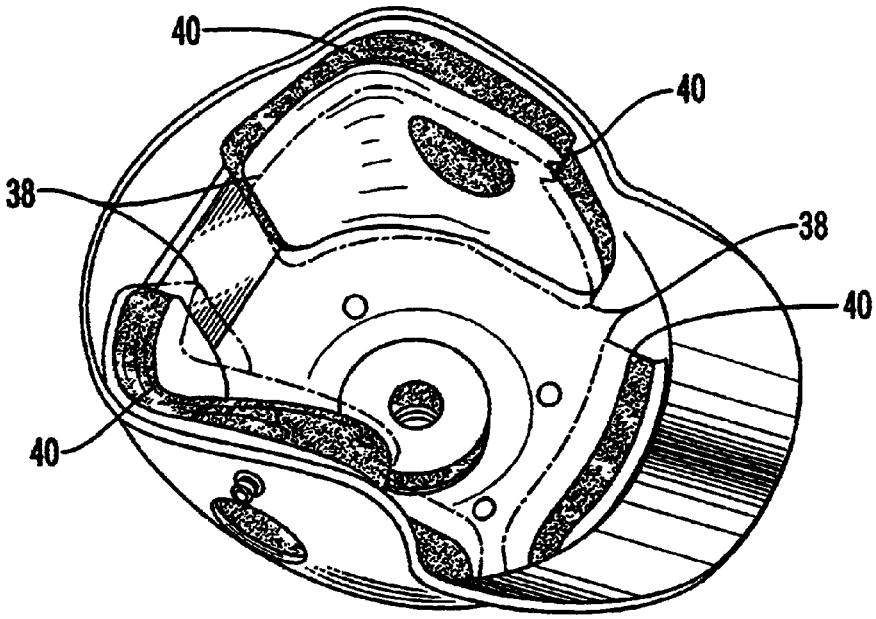
FIG. 3 is a view similar to FIG. 2.

As seen in FIGS. 2 and 3, the hinged sections 22 and 26 of the first and second helmet pads 14 and 16 are configured to move relative to both the interior surface 30 and the attachment sections 20 and 24 of the first and second helmet pads 14 and 16. The hinged sections 22 and 26 have a point of rotation 29 located near the attachment of the first pad sections 20 and 24 to the interior surface 30. This rotational motion facilitates the conformity of the padding 12 to the head of a wearer of the helmet 10 by increasing the circumferential area within the helmet in which the head of a wearer of the helmet 10 can fit.

Also, the expandable band 18 is spaced away from the internal surface 30 of the protective helmet 28. This spacing creates a gap 27 between the interior surface 30 and the expandable band 18 and hinged sections 22 and 26. This configuration allows a wearer of the helmet 10 that has pony-tail style hair to fit the hair in between the adjustable band 18 and the interior surface 30 of the protective helmet shell 28 and out the bottom of the helmet 10 without a need for an additional opening in the protective helmet shell 28. The fact that the current invention does not require that additional opening in the protective shell 28 to facilitate adjustment of the padding 12 or to accommodate pony-tail style hair maintains the full structural integrity of the helmet 10 and provides better protection for a wearer of the helmet 10.

In a preferred embodiment, the expandable band 18 is comprised of neoprene rubber which provides elasticity to allow the expansion of the second pad sections 22 and 26 of the first and second helmet pads 14 and 16. Also, the elasticity in the neoprene rubber returns the second pad sections 22 and 26 to their original positions 38 in order to accommodate the next wearer of the helmet 10. The attachment between the adjustable band 18 and the first and second helmet pads 14 and 16 is by adhesion. The adhesion can be by any technique known by those skilled in the art.

The helmet shell 28 further includes a front portion 48, left side portion 50, right side portion 52, rear portion 54, and crown portion 56. These portions 48 through 56 define the interior surface 30 of the helmet shell 28. In a preferred embodiment, the first helmet pad 14 is attached proximate the left side 50 of the helmet 10 and the second helmet pad 16 is attached proximate the right side 52 of the helmet 10. The helmet 10 further comprises a third helmet pad 32 attached proximate the front portion 48 of the helmet 10. Also, a fourth helmet pad 34 is attached proximate the crown portion 56 of the helmet 10. In a preferred embodiment, the third helmet pad 32 and the fourth helmet pad 34 are adhered to the interior surface 30 of the protective helmet shell 28.

Each helmet pad 14, 16, 32, and 34 is comprised of foam cushioning layers 36 extending from the interior surface 30 of the protective helmet shell 28. These foam cushioning layers 36 are designed to comfortably fit around the head of a wearer of the helmet 10 and to absorb the energy from objects that would otherwise strike the head of a wearer of the helmet 10.

As seen in FIGS. 2 and 3, the first and second helmet pads 14 and 16 are spaced on the interior surface 30 of the protective helmet shell 28. The design of this space configuration provides a secure engagement between the self-adjusting padding 12 and the head (not shown) of the wearer of the helmet 10. This arrangement also provides for a comfortable fit of the helmet 10 on the head of a wearer of the helmet 10.

As seen in FIG. 3, the self-adjusting padding 12 is malleable and can be compressed from its original position 38 to a compressed position 40. This movement further facilitates the adjustable nature of the self-adjusting padding 12 and provides a better comfort fit for the head of a wearer of the helmet 10.

In a preferred embodiment, the self-adjusting padding 12 is comprised of dual density foam and nylon laminated skin 46. The dual density foam provides greater energy absorption than single density foam, while the nylon laminated skin 46 provides better wear characteristics than the dual density foam by itself. The nylon laminated skin 46 also helps to prevent the soiling of the self-adjusting padding 12.

The expandable band 18 biases the second pad section 22 of the first helmet pad 14 toward second pad section 26 of the second helmet pad 16. In effect, the expandable band 18 repositions the second pad sections 22 and 26 to engage the head of a wearer of the helmet 10. The expandable band 18 provides elasticity in the positioning of the self-adjusting padding 12. This positioning further facilitates the adjustable nature of the self-adjusting padding 12 and provides a secure and comfortable fit of the self-adjusting padding 12 around the head of a wearer of the helmet 10.

Figure 5:
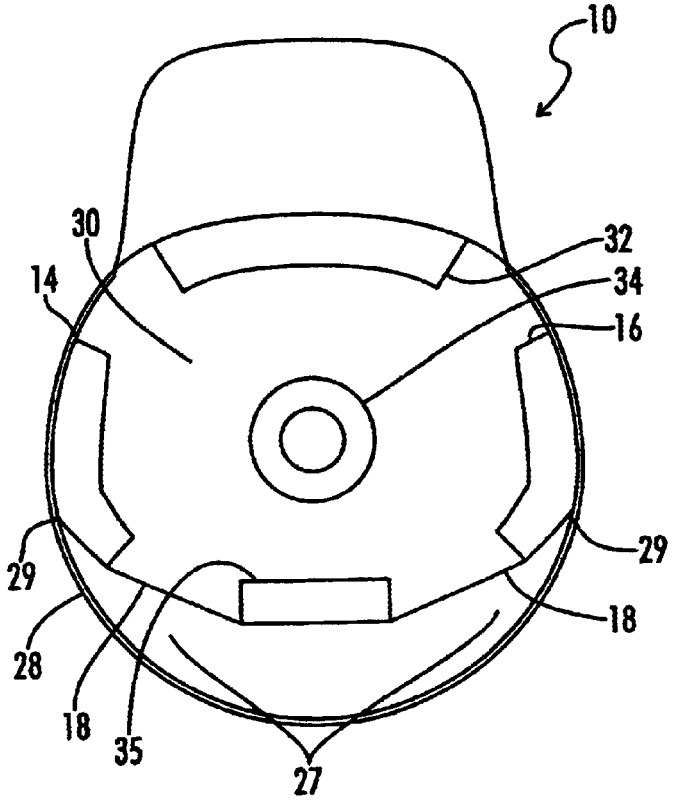
FIG. 5 is a bottom view of an alternate embodiment of the current invention showing the first and second helmet pads, two expandable bands, and rear pad spaced from the interior surface of the helmet.

In an alternate embodiment the helmet 10 comprises a fifth helmet pad 35 positioned parallel to the rear portion 54 of the helmet shell 28. The fifth helmet pad 35 is spaced from the rear portion 54 of the helmet shell 28 and engages the back of the head of the wearer of the helmet 10 when a user places the helmet 10 on his or her head. This embodiment is seen in FIG. 5.

Thus, although there have been described particular embodiments of the present invention of a new and Helmet with Self-Adjusting Padding, it is not intended that such references be construed as limitations upon the scope of this invention except as set forth in the following claims.

What is claimed is:

1. A protective batting helmet comprising:

a helmet shell including an interior surface of the helmet;

first and second helmet pads, each of the first and second helmet pads comprising a first pad section attached to the interior surface of the helmet and a second pad section spaced away from the interior surface; and at least one self-adjusting expandable band attached to each of the second pad sections, the band having a majority of its length spaced away from the helmet shell.

2. The batting helmet of claim 1 wherein the first pad sections of each helmet pad are adhered to the interior surface of the helmet.

3. The batting helmet of claim 1 wherein the first helmet pad is separated from the second helmet pad along the interior surface of the helmet by a gap and the expandable band extends across the gap.

4. The batting helmet of claim 1 wherein the expandable band biases the second pad section of the first helmet pad toward the second pad section of the second helmet pad.

5. The batting helmet of claim 1 wherein the expandable band is spaced away from the interior surface of the helmet.

6. The batting helmet of claim 1 wherein:

the helmet shell further includes a front portion, left side portion, right side portion, rear portion, and crown portion defining the interior surface;

the first helmet pad is attached proximate the left side of the helmet and the second helmet pad is attached proximate the right side of the helmet; and the helmet further comprises a third helmet pad attached proximate to the front portion of the helmet.

7. The batting helmet of claim 6 further comprising a fourth helmet pad attached proximate the crown portion of the helmet.

8. The batting helmet of claim 6 wherein the first helmet pad is positioned proximate the left side of the helmet and the second helmet pad is positioned proximate the right side of the helmet such that the band is position proximate the rear of the helmet.

9. The batting helmet of claim 1 wherein the first and second helmet pads comprise foam cushioning layers.

10. A protective batting helmet worn on the head of a user comprising:

a helmet shell having an interior surface;

first and second helmet pads each having an attached section attached to the interior surface of the helmet and a hinged section spaced away from the interior surface of the helmet;

the hinged sections of the first and second helmet pads separated by a pad gap;

at least one self-adjusting expandable band attached to the hinged sections of the first and second pads, spaced from the helmet shell, and extending across the pad gap;

wherein the band is spaced away from the interior surface of the helmet so that when the helmet is worn by a user, the band and hinged sections of the first and second helmet pads can adjust to the user's head by moving outward toward the helmet interior surface.

wherein the first and second helmet pads are positioned in an opposed relationship on respective left and right sides of the helmet to position the pad gap at a rear portion of the helmet.

* * * * *